US012662804B2

(12) United States Patent
Boeltl et al.

(10) Patent No.: US 12,662,804 B2
(45) Date of Patent: Jun. 23, 2026

(54) HYBRID TOILET

(71) Applicant: Acorn Engineering Company, City Of Industry, CA (US)

(72) Inventors: Darryl M. Boeltl, Whittier, CA (US); Christopher Adkison, Ontario, CA (US)

(73) Assignee: Acorn Engineering Company, City of Industry, CA (US)

( * ) Notice: Subject to any disclaimer, the term of this patent is extended or adjusted under 35 U.S.C. 154(b) by 256 days.

(21) Appl. No.: 18/468,497

(22) Filed: Sep. 15, 2023

(65) Prior Publication Data

US 2025/0092657 A1 Mar. 20, 2025

(51) Int. Cl.

| | |
|---|---|
| ***E03D 11/06*** | (2006.01) |
| ***E03D 3/00*** | (2006.01) |
| ***E03D 11/16*** | (2006.01) |
| ***E03D 11/18*** | (2006.01) |

(52) U.S. Cl.

CPC ..... *E03D 11/06* (2013.01); *E03D 3/00* (2013.01); *E03D 11/16* (2013.01); *E03D 11/18* (2013.01)

(58) Field of Classification Search

CPC ..... E03D 3/00; E03D 11/06; E03D 11/16; E03D 11/18; F16L 43/00; F16L 43/005; F16L 43/006

USPC ..... 4/421, 424, 425, 428, 434, 237

See application file for complete search history.

(56) References Cited

U.S. PATENT DOCUMENTS

| | | | | |
|---|---|---|---|---|
| 5,832,546 | A * | 11/1998 | Inch | E03D 3/00 4/425 |
| 11,692,338 | B2 * | 7/2023 | Harrison | E03D 3/00 4/425 |
| 2017/0121955 | A1 | 5/2017 | Hall et al. | |
| 2019/0257065 | A1 | 8/2019 | Schibur et al. | |
| 2019/0292763 | A1 * | 9/2019 | Boeltl | E03D 11/17 |
| 2023/0175245 | A1 * | 6/2023 | Helmstetter | E03D 11/16 4/425 |

FOREIGN PATENT DOCUMENTS

| | | | | |
|---|---|---|---|---|
| BR | 202021007886 U | | 8/2021 | |
| CN | 206737067 U | | 12/2017 | |
| CN | 110616785 A | | 12/2019 | |
| GB | 2045311 A | * | 10/1980 | E03D 11/02 |
| WO | 2022/188727 A1 | | 9/2022 | |

* cited by examiner

*Primary Examiner* — Tuan N Nguyen
(74) *Attorney, Agent, or Firm* — Honigman LLP; Eric J. Sosenko; Jonathan P. O'Brien

(57) ABSTRACT

A toilet for connecting a flush valve to a drain pipe of a waste drainage system. The toilet includes a housing, a bowl, a seat and a P-trap assembly. The bowl is enclosed by the housing and includes a waste receptacle defined between an upper opening and a waste outlet of the bowl. The seat is coupled to the bowl and defines a seating surface with a central opening above the bowl. Additionally, the seat cooperates with the bowl to define an open rinse slot that extends about at least a portion of the bowl. The P-trap assembly includes an inlet positioned at and connected to the waste outlet of the bowl.

26 Claims, 10 Drawing Sheets

HYBRID TOILET

BACKGROUND

1. Field of the Invention

The present invention generally relates to toilets. More specifically the invention relates to ligature resistant toilets

2. Description of Related Art

Toilets typically include a bowl and a seat. Often the seat is hingedly mounted to the bowl such that the seat can be rotated between two positions, a down position where the seat overlies the rim of the bowl and an up position where the seat extends generally vertically upward from the bowl. On some toilets, the bowl and the seat may be monolithically formed, such that the seat cannot be rotated relative to or otherwise removed from the bowl. Toilets of this type are often used in institutional settings, including long term care facilities and prison, and may be referred to as ligature-resistant toilets since the design of the toilet reduces points that would allow for the fixation of a ligature to the toilet.

To evacuate waste from the toilet, toilets may be gravity-assisted, pressure-assisted or vacuum-assisted.

In a gravity-assisted toilet, water is supplied to the bowl from a tank located in elevated in position relative to the bowl. Water, under the force of gravity, is provided to the bowl to assist with the evacuation of waste from the bowl, thought the bowl's outlet and a waste conduit coupled to the drain pipe of a waste collection system or sanitary sewer system.

In a pressure-assisted, water is provided from a pressurized source, such a pressurized water supply line. Pressurized water is directed into the bowl where after gravity operates to empty the contents of the bowl into the waste conduit and drain pipe.

In both the gravity-assisted and pressure-assisted toilets, the waste conduit may be provided with a blow-out jet. The blow-out jet provides a jet of water, bypassing the bowl, into the waste conduit at a location downstream of the P-trap located immediately after the bowl outlet. The jet of water initiates a siphon action on the water in the P-trap to begin clearing of the water and waste in the bowl.

In a vacuum-assist toilet, the evacuation of waste from the bowl through the waste conduit is facilitated by the application of a vacuum to the waste conduit.

One common issue with toilets used in institutional settings, particularly long term care facilities, is the aesthetics of the toilet. Current institutional toilets have an "institutional" look and are typically constructed completely of stainless steel with a prominently defined bowl and a unitarily formed seat. As such, the institutional toilet has a "hard" look and lacks aesthetics more similar to a conventional toilet found in a residential setting. A toilet having the functionality of an institutional toilet, but the aesthetics of a residential toilet is not currently available.

SUMMARY

In one aspect of the invention, a toilet is provided for connecting a flush valve to a drain pipe of a waste drainage system. The toilet includes a housing, a bowl, a seat and a P-trap assembly. The bowl is enclosed by the housing and includes a waste receptacle defined between an upper opening and a waste outlet of the bowl. The seat is coupled to the bowl and defines a seating surface with a central opening above the bowl. Additionally, the seat cooperates with the bowl to define a rinse slot that extends about at least a portion of the bowl. The P-trap assembly includes an inlet positioned at and connected to the waste outlet of the bowl.

In another aspect, the rinse slot is open along its length.

In a further aspect, the rinse slot is open along its entire length.

In an additional aspect, the rinse slot is defined at least in part by an upper surface of the bowl.

In yet another aspect, the rinse slot is defined at least in part by a rinse channel defined in an upper surface of the bowl.

In a further aspect, the upper surface of the bowl is formed as a flushing rim, the flushing rim being attached to an upper portion of a receptacle of the bowl.

In an additional aspect, the rinse slot includes a floor defined in an upper surface of the bowl, the floor extending radially inward from an outboard wall defined in an upper surface of the bowl.

In still another aspect, the floor is downwardly sloped from the outboard wall to a central opening defined by bowl.

In yet a further aspect, the rinse slot decreases in width along opposing sides progressing from the rear of the bowl toward the front of the bowl.

In an additional aspect, the rinse slot includes a raised land formed therein, the raised land being located toward a rear side of the bowl.

In another aspect, the seat includes a downwardly extending lip located along at least a portion of the central opening of the seat.

In a further aspect, the lip is located toward a rear side of the seat.

In an additional aspect, the toilet further includes a rinse water supply line, a refill reservoir and a flush valve spud connection. The flush valve spud connection is configured for connection to the flush valve, while the rinse water supply line includes a nozzle terminating at and configured for directing rinse water into the rinse slot. The refill reservoir is fluidly connects the flush valve spud connection to the rinse water supply line and including a plurality of walls defining a reservoir chamber having a upper end and a lower end.

In another aspect, the rinse water supply line is coupled to the refill reservoir adjacent to the lower end of the reservoir chamber.

In further aspect, a blow-out jet water supply line is included with the toilet and includes a blow-out jet nozzle connected to the P-trap assembly such that the refill reservoir fluidly connects the flush valve spud connection to the blow-out jet water supply line.

In an additional aspect, the blow-out jet water supply line is coupled to the refill reservoir adjacent to the lower end of the reservoir chamber.

In another aspect, the refill reservoir is positioned at a height in the toilet above a height in the toilet where the blow-out jet nozzle is coupled to the P-trap assembly.

In a further aspect, the refill chamber defines a volume and has a shape that decreases in volume from the upper end to the lower end of the refill reservoir.

In an additional aspect, the plurality of walls includes side walls, at least one side wall being angled toward an opposing side wall proceeding from the upper end to the lower end.

In another aspect, the housing the housing, bowl and seat are constructed of a first material, and the refill reservoir is constructed of a second material, the first material being a solid surface material and the second material being different than the first material.

According to another aspect of the invention, a hybrid toilet is provided. The hybrid toilet includes a housing, a bowl enclosed by the housing and including portions defining a receptacle having a waste outlet. A seat is coupled to the bowl and defines a seating surface above the bowl. The housing, bowl and seat are formed of a first material, which is a solid surface material. The hybrid toilet also includes a P-trap assembly having an inlet positioned at and connected to the waste outlet of the bowl. The P-trap assembly is constructed of a second material, that is different than the first material.

In another aspect, the second material is stainless steel.

In a further aspect, the P-trap assembly includes a reverse bend having a first section extending downward from waste outlet and a second section extending upward from the first section.

In an additional aspect, the second section extends upward to a position above the waste outlet.

In another aspect, the seat is fixed and immoveable relative to the housing.

In a further aspect, a transition area between the seat and housing is formed as a smooth transition surface.

Further objects, features and advantages of the invention will become readily apparent to persons skilled in the art after review of the following description with reference to the drawings and the claims that are appended to inform a part of this specification.

DETAILED DESCRIPTION

As used in the description that follows, directional terms such as "upper" and "lower" are used with reference to the orientation of the elements as presented in the figures or as the device would be installed. Accordingly, "upper" indicates a direction toward the top of the figure and "lower" indicates a direction toward the bottom of the figure. The terms "front," "rear," "left" and "right" are similarly interpreted. The terms "inward" or "inner" and "outward" or "outer" indicate a direction that is generally toward or away from a central axis of the referred to part, whether or not such an axis is designated in the figures showing the part. An axial surface is one that faces in a direction along the axis. In other words, an axial surface is provided in a plane oriented generally perpendicular to the central axis. A radial surface is therefore in a plane incorporating the axis and faces radially, generally toward or away from the central axis. It will be understood, however, that in actual implementation, the directional references used herein may not necessarily correspond with the described installation and orientation of the corresponding components or device.

Figure 1A:
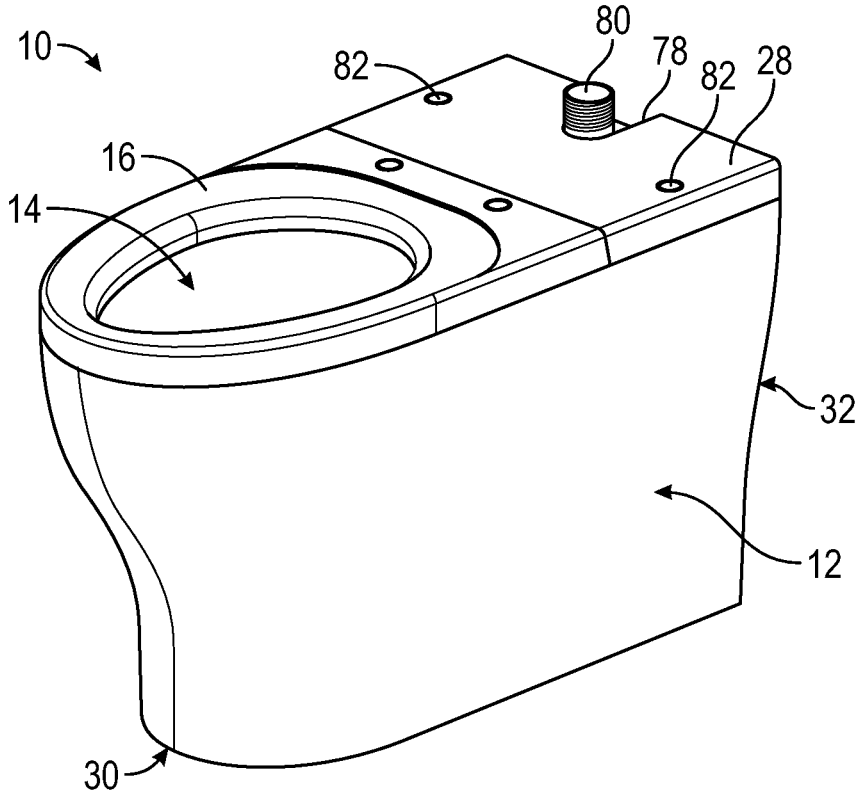
FIG. 1A is a perspective view of top-supply flush toilet embodying the principles of the present invention.
Figure 1B:
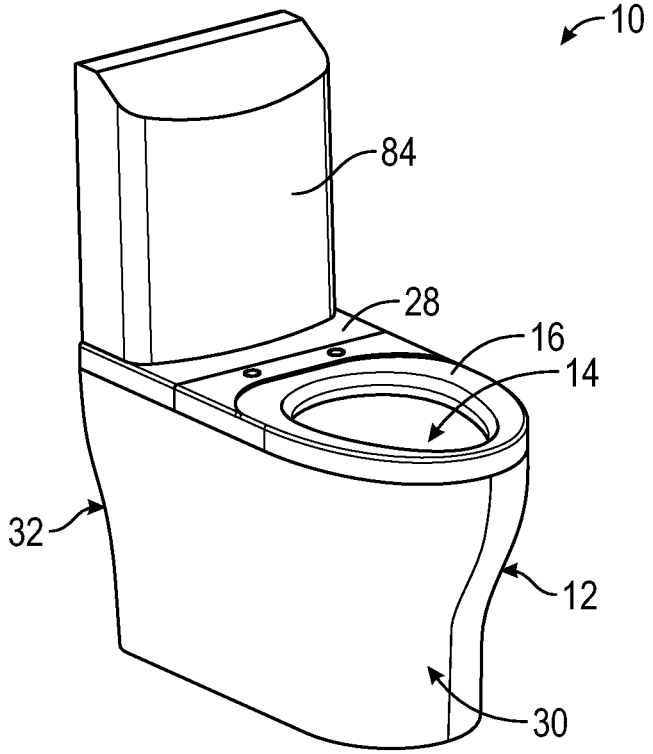
FIG. 1B is a perspective view of the top-supply flush toilet seen in FIG. 1A as intended to be installed with a cover to conceal the connection with the water supply line exiting the wall above the base of the toilet.
Figure 2A:
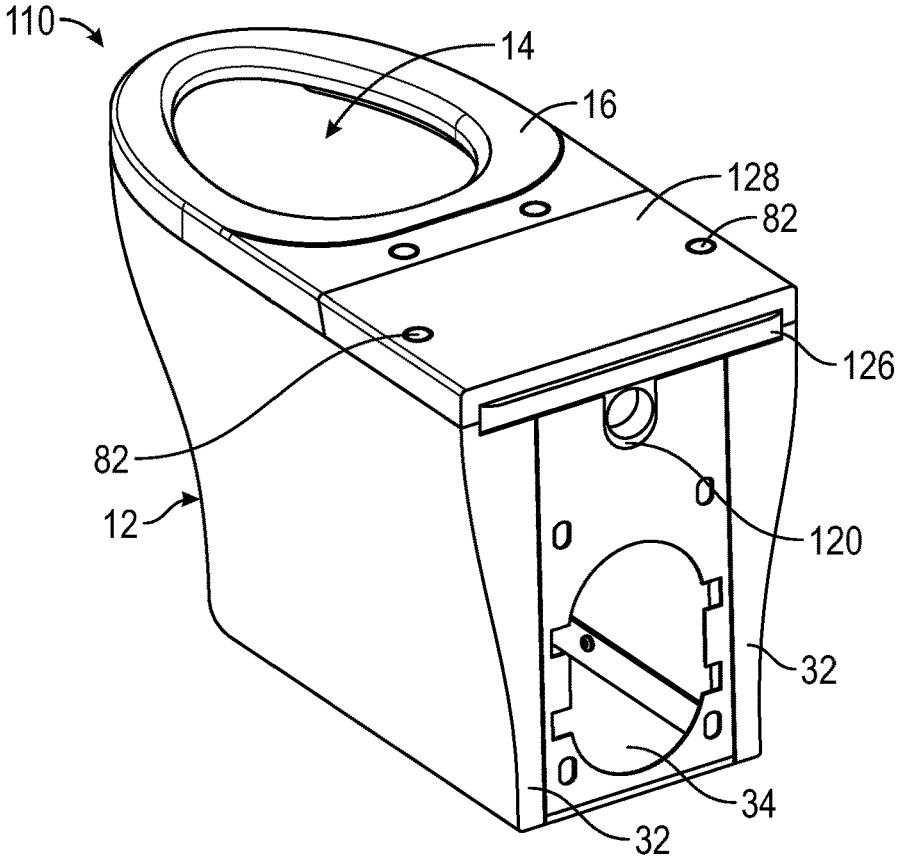
FIG. 2A is a perspective view of rear-supply flush toilet embodying the principles of the present invention.
Figure 2B:
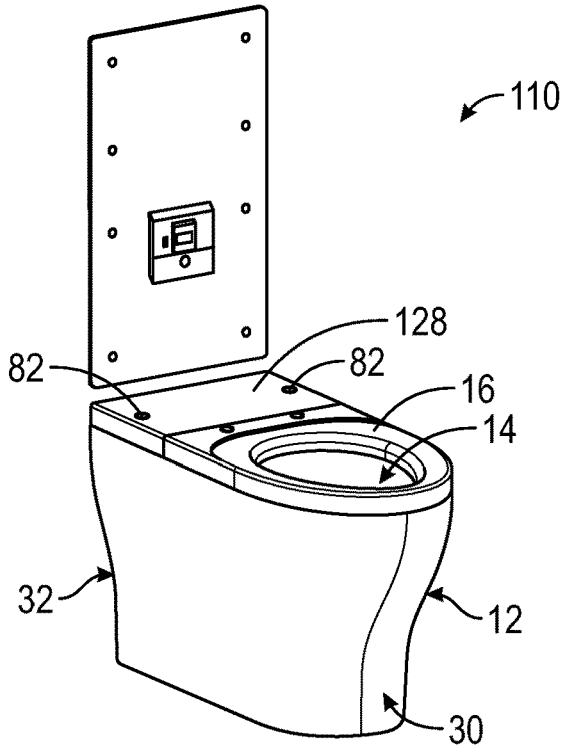
FIG. 2B is a perspective view of the rear-supply flush toilet seen in FIG. 2A as intended to be installed with a wall mounted flush sensor and manual activation button.

Referring now to the drawings, toilets embodying the principles of the present invention are generally illustrated in FIGS. 1A, 1B, 2A and 2B, in which FIGS. 1A and 1B illustrate a toilet 10 of a top-supply flush valve variety, while FIGS. 2A and 2B show a toilet 110 of a wall-supply flush valve variety. Additionally, FIGS. 1A and 2A show the toilets 10, 110 freestanding and FIGS. 1B and 2B show the toilets 10, 110 as generally installed.

Figure 3:
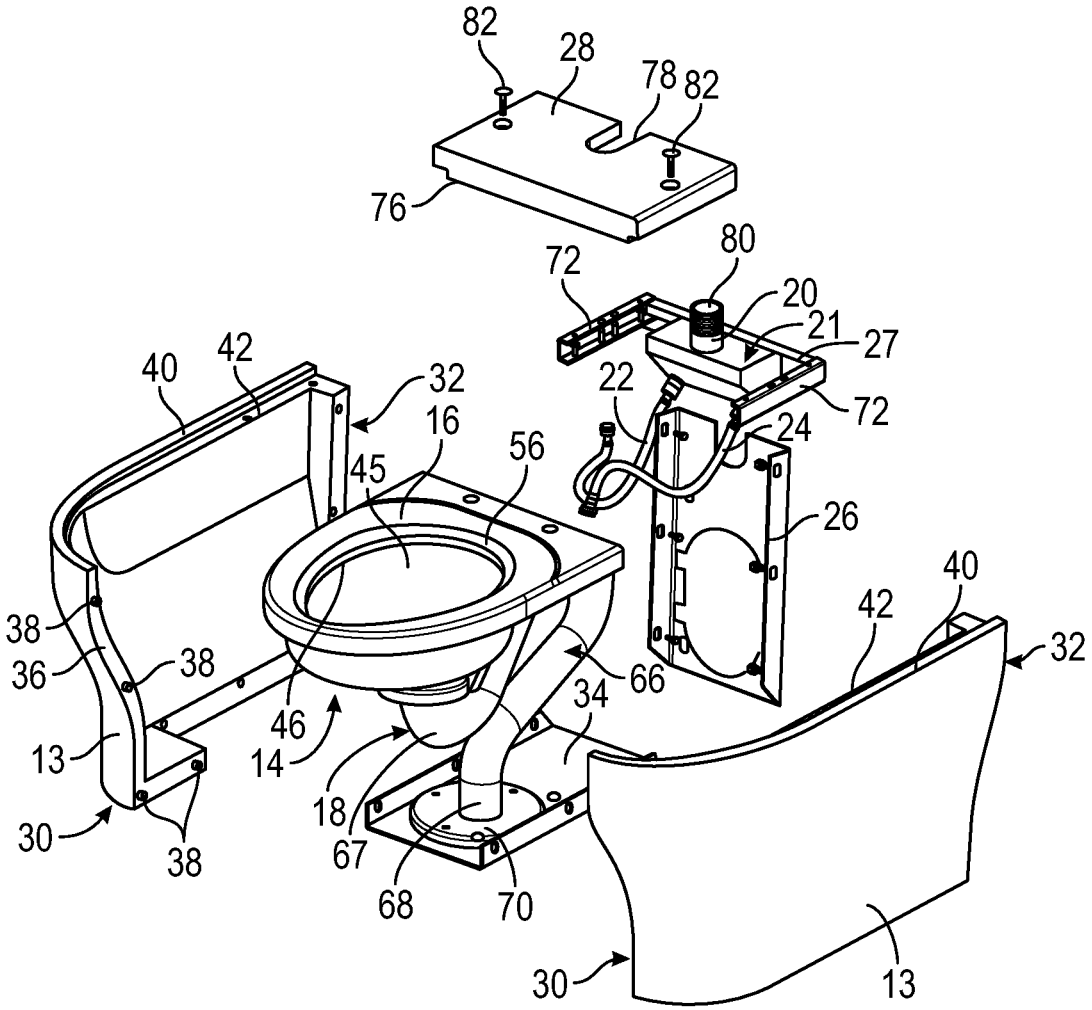
FIG. 3 is an exploded view of the toilet seen in FIG. 1A.

Referring now to FIG. 3, illustrated therein is an exploded view of the top-supply flush valve toilet 10. The toilet 10 includes as it principal components a housing 12, a bowl 14, a seat 16, a P-trap assembly 18, a flush valve spud connection 20, a refill reservoir 21, flexible water supply lines 22, 24, a mounting bracket 26 and a top access cover 28. While the toilets 10, 110 of FIGS. 1A and 2A differ as to how flush water is initially delivered to the toilet, the construction of the toilets is otherwise substantially the same and includes many common parts. Accordingly, components common to both varieties of toilets 10, 110 are referred herein using common nomenclature but with reference characters designated as a 0XX series and 1XX series, respective. For example, the top-supply toilet 010 and its the flush valve spud connection 020 are designated by reference characters leading with 0, which will typically be omitted, while the rear-supply toilet 110 and its flush valve spud connection 120 are designated by reference characters leading with 1, which is not omitted. Generally, other than the types of flush valve spud connections and a related components, such as the wall mounting bracket, top access covers and a valve cover, the two varieties of toilets 10, 110 have the identical components and constructions. Accordingly, throughout the various figures the two varieties of toilets are interchangeably shown and identical components will not be repetitively discussed in the interest of brevity.

Figure 4:
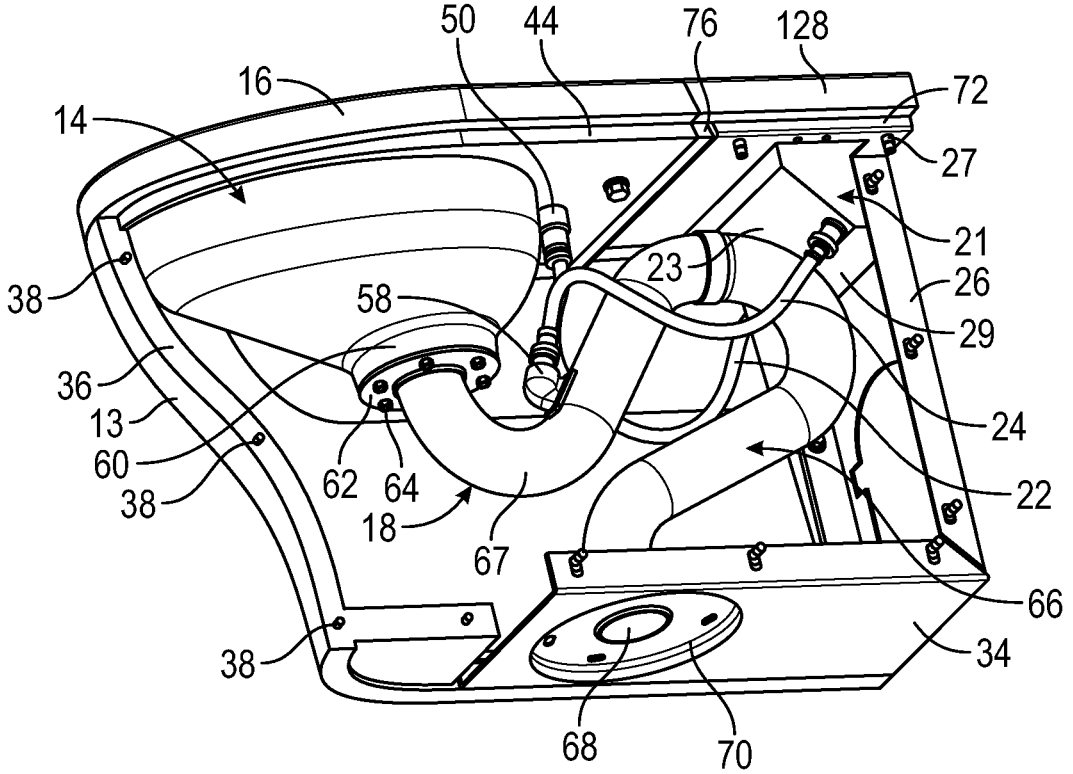
FIG. 4 is perspective side view of the toilet with one half of the housing removed.

Referring back to FIG. 3, and to FIG. 4, the housing 12 is provided as a clam shell, meaning the housing is formed of two side halves 13 that join together at one end, the front end 30, and are spaced apart at the other end, the rear end 32. As such, the housing 12 extends generally forward from the rear end 32 with a generally constant profile, the upper portion being wider than the lower portion and smoothly transitioning between the upper and lower portions thereby providing the housing with a generally inverted bell-shaped cross section, as readily seen in FIG. 2A. In addition to be joined at the front end 30, the housing halves 13 are also joined together at the lower end by an integral base plate 34 extending laterally from both sides. To facilitate the joining of the two halves 13 of the housing 12, and as particularly seen in FIG. 4, the mating edge 36 of one of the halves 13 may be provided with protruding dowel pins 38 that are received in corresponding bores (not shown) formed in the mating edge 36 of the other housing half 13. When joining the two halves 13, where contacting one another, the halves 13 are adhesively bonded and finished to minimize the visibility of the seam located at the front of the housing 12, thereby providing the housing 12 with a solid, one-piece appearance. The mounting bracket 26 is mounted between the rear of the housing halves 13 and secured thereto by threaded fasteners (not shown).

The housing halves 13 are manufactured (molded) out of an engineered solid surface material, which may be a combination of minerals (e.g. aluminum trihydrate), binding resin (e.g. acrylic), pigment and catalyst. The result is a strong, non-porous material for the toilet 10, 110 without the industrial feel of stainless steel and generally mimicking the appearance of a modernistic china toilet.

Figure 5:
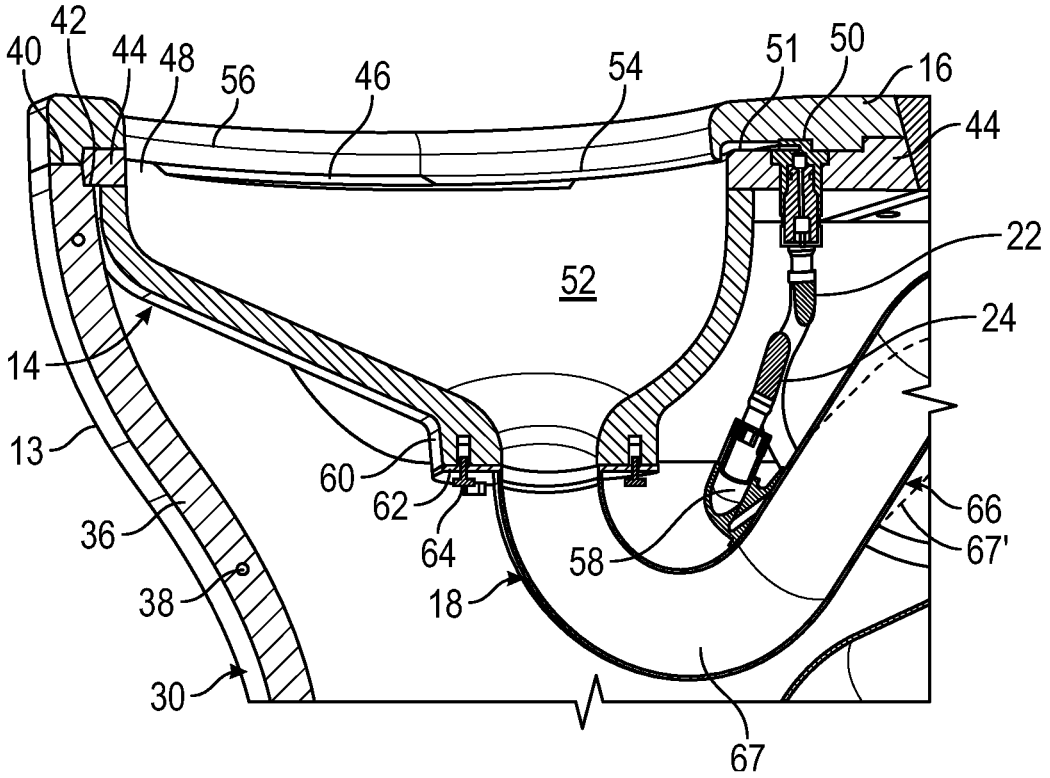
FIG. 5 is enlarged cross-sectional view of a portion of the toilet.
Figure 6:
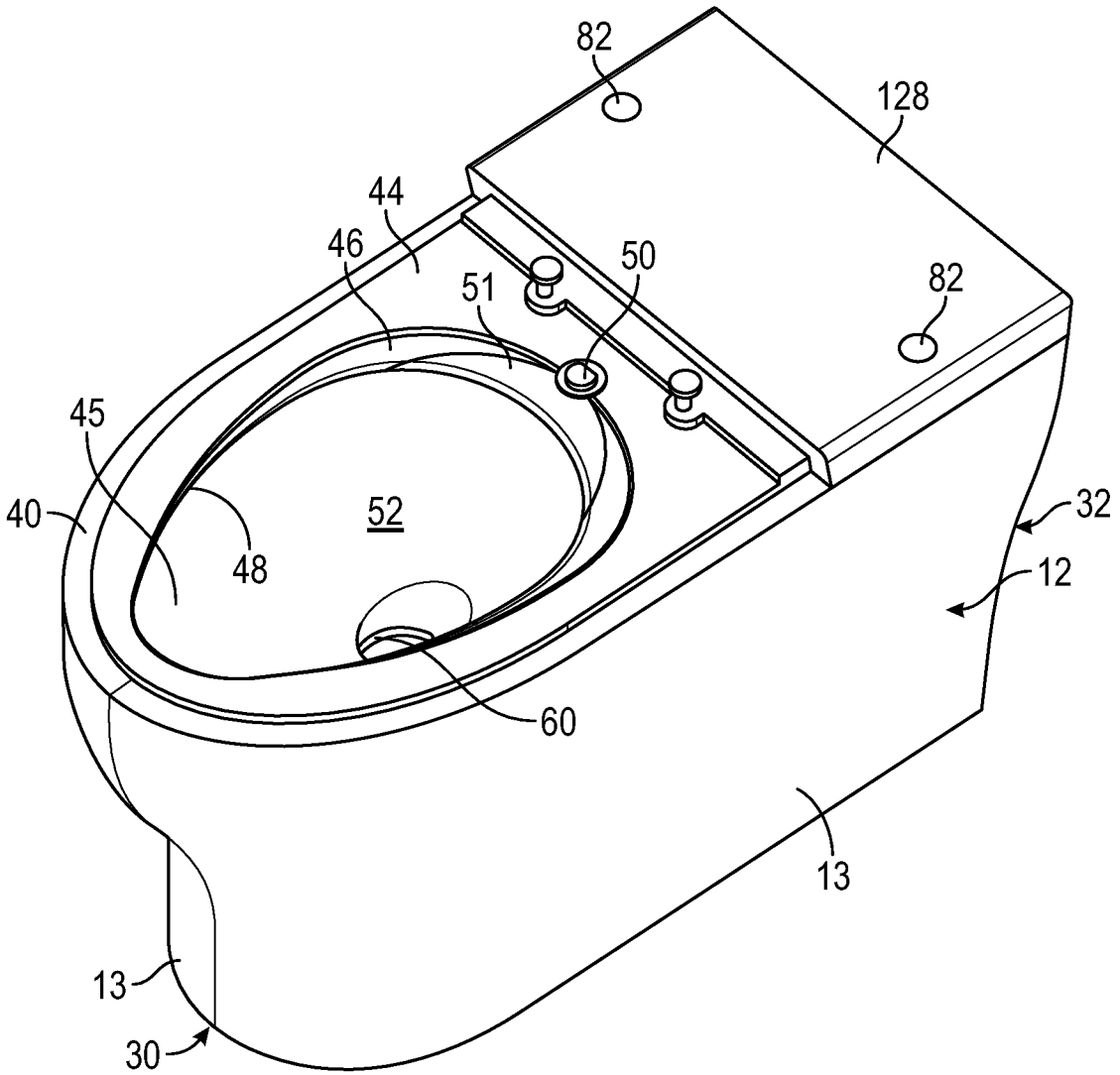
FIG. 6 is perspective view of the toilet with the seat removed from the flushing rim and bowl.
Figure 7:
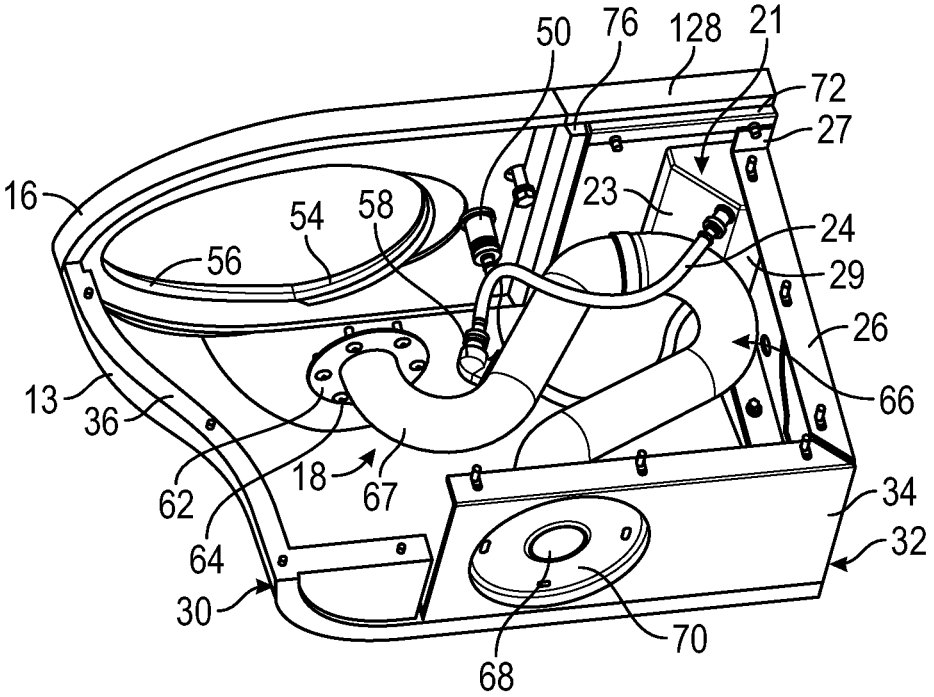
FIG. 7 is a perspective view of the toilet, with the bowl and half of the housing removed, showing the underside of the seat and the bottom of the flushing rim.

The bowl 14 and seat 16, which are also formed of solid surface materials, are integrated together and mounted to an upper surface 40 and adjacent step 42 of the housing 12. As seen in FIGS. 3-5, the step 42 is a stepped down surface along the inner perimeter of each half of the housing 12 and is located radially inward of the upper surface 40, which forms the outer perimeter of the upper portion of the housing 12. The seat 16 is joined to the bowl 14 by an adhesive so as to form a water tight seal therebetween. The bowl 14 is formed from two components, a flushing rim 44 and a receptacle 45. In FIG. 6, the seat 16 is removed to show the flushing rim 44, which forms the upper portion of the bowl 14, mounted to the housing 12. In FIG. 7, the bowl 14 is removed to show the seat 16 mounted to one of the halves 13 of the housing 12.

As seen in FIG. 6, the bowl 14 is rimless, meaning it lacks an enclosed passageway and series of ports to disperse flush water about the bowl. Rather, on the upper surface of the bowl 14, the flushing rim 44 is provided with a rinse channel 46 that directs rinse water progressively about the central opening 48 of the rim 44. The rinse channel 46 is open on its upper side and has a tapering width that is largest at the rear of flushing rim 44, in the vicinity of a spreader 50 that extends upward through the flushing rim 44. As such, the rinse channel 46 decreases in width, progressively, from the rear of the bowl 14 toward the front of the bowl 14 and may extend completely or less than completely about the bowl 14.

Included in the rear of the rinse channel 46, near the spreader 50, is a crescent shaped, raised land 51. The width of the land 51, as seen in FIG. 6, is greatest immediately in front of the spreader 51 and decreases as the land 51 progresses about the central opening 48. The land 51 has a height that is less than the overall depth of the rinse channel 46. Accordingly, the land 51 reduces the volume of the rinse channel 46 in front of the spreader and divergently away from the spreader 50 in the rear area of the rinse channel 46. As a result of the shape of the land 51, a reduced volume of rinse water is permitted to flow over the land 51 into the receptacle 45 of the bowl 14 and a greater volume of rinse water is caused to flow about the sides of the rinse channel 46 and into the receptacle 45.

The spreader 50 is a nozzle connected to the water supply line 22 and emits water in an approximately 180° fan pattern thereby directing the rinse water along the rinse channel 46 and toward the front end of the flushing rim 44. The rise water is directed so as to smoothly engage the side of the rinse channel 46, whose tapered width reduces in the direction of the front of the channel 46. Along with the provision of the land 51, by smoothly engaging the side of the rinse channel 46, with an angle of incidence of 75° or more, the flow of rinse water progresses along the length of the channel 46 and a substantially equal amount of water flows over the edge of the central opening 48 at any point along the rinse channel's inner perimeter. To further aid in this flow, the floor of the rinse channel 46 may be angled slightly downward and radially inward toward the central opening 48 from an outboard wall of the rinse channel 46.

As previously noted, the seat 16 is integrated with the bowl 14. When mounted to the bowl 14, the seat 16 cooperates with the rinse channel 46 and forms an upper surface thereover, defining a continuously open slot, slit or channel about the bowl 14 and providing uniform dispersion of rinse water that is directed into the bowl 14. As shown herein, the rinse slot is seen as extending completely about the bowl 14. However, the rinse slot may extend less than completely about the bowl 14. This extent, however, should be substantially about the bowl 14, namely at least 75% about the bowl 14. Additionally, the seat 16 may have a contrasting color relative to the remainder of the toilet 10, 110. The contrasting color of the seat 16 allows for a person to more easily visual identify the seat 16 prior to use.

To aid in directing water downward onto the collection surface 52 of the receptacle 45 of the bowl 14, the seat 16 may include a diverter dam 54 along the inner rear edge of the seat 16, in other words, on the large radii of the oval forming the correspond central opening 56 of the seat 16 and adjacent to the land 51. The diverter dam 54 is provided as a downwardly directed lip, spaced just inward from the central opening 48 of the flushing rim 44, and extends over an angle of between 110° to 180° measured from the center of the opening 56. This angle may be greater than the corresponding angle defined by the land 51. The diverter dam 54 is seen in FIGS. 5 and 7.

Figure 8:
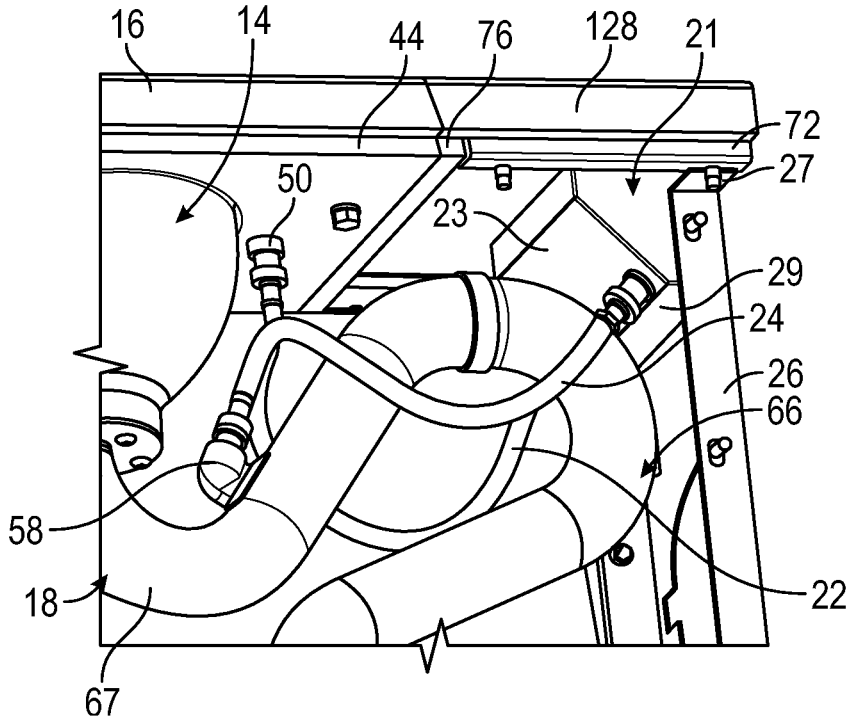
FIG. 8 is an enlarged view of the refill reservoir, the blow-out jet, water supply lines and P-trap assembly of the toilet.
Figure 9A:
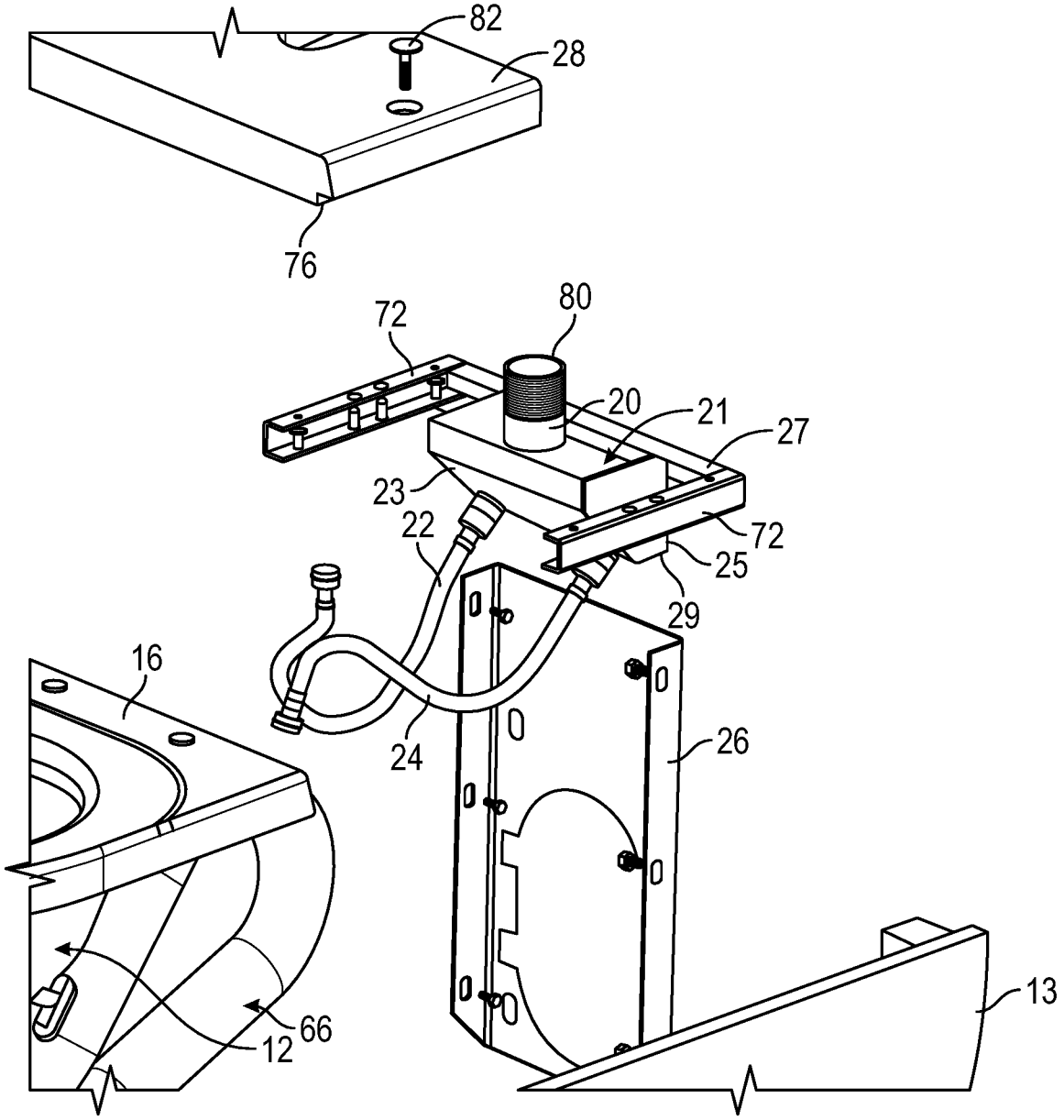
FIG. 9A is an exploded view of a rear portion of the toilet showing the flush valve spud connection, refill reservoir and water supply lines.
Figure 9B:
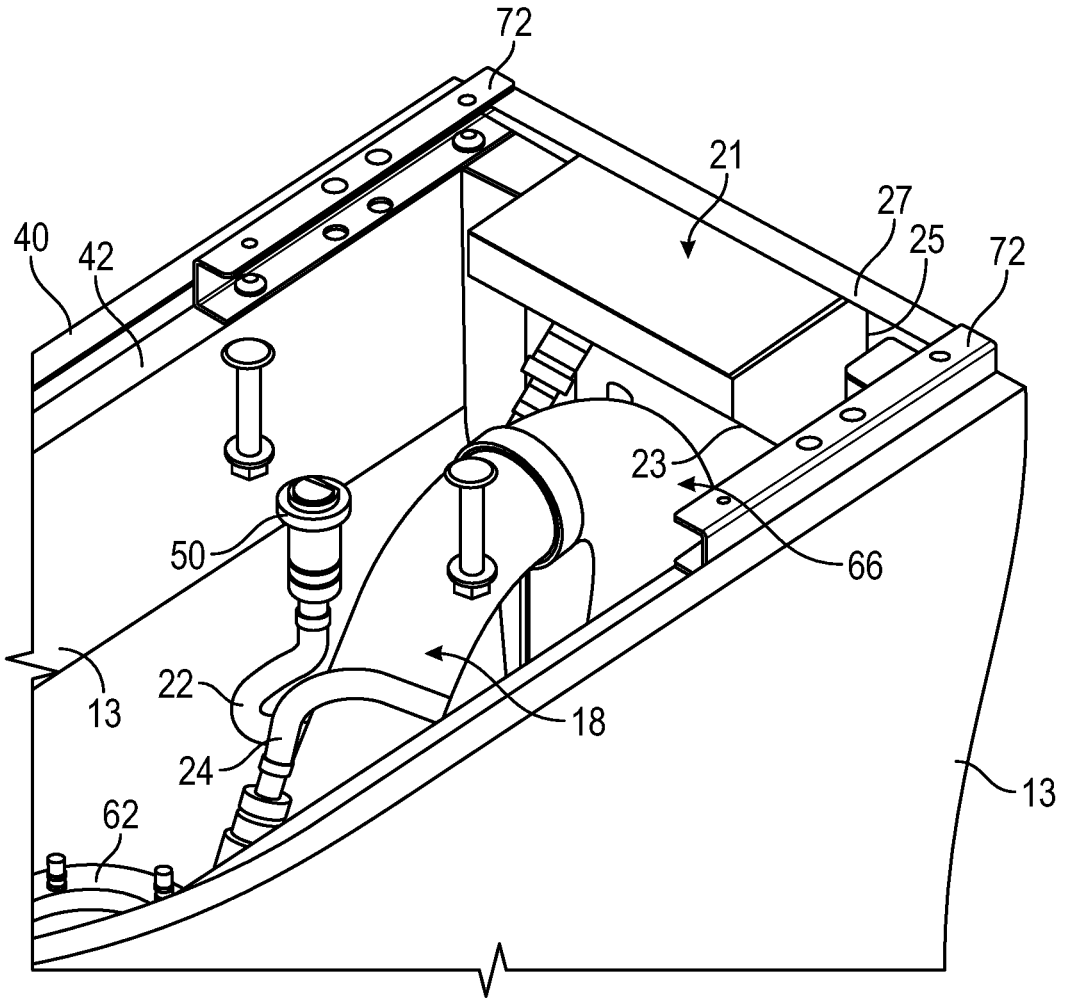
FIG. 9B is a perspective view of the toilet with the flushing rim, seat and access cover removed to show the refill reservoir in relation to the housing.

As readily seen in FIGS. 4, 7 and 8, the spreader 50 is coupled to the water supply line 22, and the water supply line 22 is in turn coupled to the refill reservoir 21 and to the flush valve spud connection 20, 120, which is configured for connecting to the water supply (not shown) of the facility where installed. The second water supply 24, which is also coupled to the refill reservoir 21 and the flush valve spud connection 20, 120, extends from the refill reservoir 21 and flush valve spud connection 20, 120 to supply water to a blow-out jet 58, as further discussed below.

The receptacle 45 of the bowl 14, includes an outlet port 60 for discharging water and waste from the bowl 14 during flushing. The outlet port 60 is configured to have secured thereto a mounting flange 62 of the P-trap assembly 18, which is preferably made of stainless steel. As seen in FIG. 5, the mounting flange 62 is secured by removeable fasteners 64, such as threaded bolts, allowing the toilet 10, 110 to be mounted in either a floor outlet or rear outlet installation through use of an appropriately configured P-trap assembly 18. In the figures, the P-trap assembly 18 is connected to a waste conduit 66, which is shown in a floor outlet configuration. It will be appreciated, however, that the P-trap assembly 18 and waste conduit 66 may be provided in a rear or wall waste outlet configuration where the discharge end 68 of the waste conduit 66 exits the toilet 10, 110 through the rear of the toilet 10, 110 instead of the bottom of the toilet 10, 110.

The P-trap assembly 18, in addition to the mounting flange 62, includes at its proximal end a curvature of about 135° to 180° such that the conduit initially extends downward from the outlet port 60, then curves rearward and upward. This curvature is generally referred to as the U-bend or trap 67. Thereafter, the trap arm turns rearward and, preferably, slightly downward to define the weir of the P-trap assembly 18. Provided in this manner, residual water collects in the bowl 12 and P-trap assembly 18, up to the weir, and prevents odorous gas, traveling upward from the drain pipe, from being emitted through the outlet port 60, to the bowl 14 and into the room where the toilet 10, 110 is installed. After the trap 67 and trap arm, the connected waste conduit 66 is provided with a curvature that redirects the waste conduit 66 from an upwardly extending direction to a downwardly extending direction (in a floor outlet configuration) or rearwardly extending direction (in a rear outlet configuration), depending on the installation, and to the discharge end 68 of the waste conduit 66. The discharge end 68 is secured to the drain pipe by appropriate means, including, for example, a gasket flange 70 (see FIGS. 3 and 4). To accommodate different rough-in dimensions for either floor outlet configurations or wall outlet configurations, differently configured or shaped P-trap assemblies 18 and/or the waste conduits 66 may be employed with a common housing 12, bowl 14 and seat 16 configuration. For example, the curvature of the U-bend and/or the length and resulting height of the trap arm may differ from one configuration of the P-trap assembly 18 to another, as shown in phantom in FIG. 5 and designated at 67'.

Referring now to FIGS. 5 and 8, immediately after the initial curvature of the waste conduit 66, the blow-out jet 58 is provided where water resides in the trap 67 after flushing of the toilet 10, 110. The during flushing of the toilet 10, 110, a stream of water is emitted from the blow-out jet 58 in the waste conduit 66 in a downstream direction, e.g. away from the bowl 14 and toward the discharge end 68 of the waste conduit 66. The force of this stream of water initiates a siphon action on the residual water in the trap 67 and bowl 14, which assists in flushing the waste and water from the bowl 14 as rinse water is being introduced into the bowl 14.

During flushing of the toilet 10, 110, the flush valve (not shown) allows water to be introduced, via the flush valve spud connection 20, 120, into the refill reservoir 21 and from the reservoir 21 through the water supply lines 22, 24 to the spreader 50 and blow-out jet 58. From the spreader 50, water is distributed into the bowl 14 via the rinse channel 46, while the blow-out jet 58 initiates a siphon action in the waste conduit 66. The refill reservoir 21 defines a extra volume of water that is employed after flush valve has closed. Once the flush valve has closed, the extra volume of water in the refill reservoir 21 drains from the refill reservoir 21, under the influence of gravity, through the water supply lines 22, 24, spreader 50 and blow-out jet 58 and into the trap 67. As a result, the trap 67 and lower portion of bowl 14 are refilled with residual water to block odorous gas.

To aid in the above, the refill reservoir 21 is preferably positioned as high as possible in the toilet 10 and, relatively speaking, at a height greater than one or both of the spreader 50 and blow-out jet 58. More specifically, the refill reservoir 21 is positioned in the toilet 10 at a height greater than the weir of the P-trap assembly 18, which will correspond to the height of the residual water in the bowl 12 after flushing. As such, the refill reservoir 21 may be located immediately below and adjacent to a rear access cover 28, 128, which is further discussed below.

The refill reservoir 21 includes an internal chamber defined by a plurality of walls so as to contain a predetermined volume of rinse water therein that corresponds with the desired volume of residual water in the bowl 14 and P-trap assembly 18 after flushing of the toilet 10. In the illustrated embodiment, the refill reservoir 21 has an elongated, box-shaped construction that decreases in volume, i.e. narrows, toward a lower end of the refill reservoir 21. As such, one of the side walls of the refill reservoir 21, such as front wall 23, is angled relative to an opposing side wall, such as rear wall 25. Further, the water supply lines 22, 24 are connected to the refill reservoir 21 at a location toward the bottom of the refill reservoir 21. As shown, this connection is made in the front wall 23, adjacent to the bottom wall 29 of the refill reservoir 21. Alternatively, the connection could be made in the bottom wall 29 or another wall of the refill reservoir 21.

The flush valve spud connection 20, 120 is provided with the refill reservoir 21 in a manner for the specific spud connection, at the top thereof for a top-supply flush toilet and at the rear thereof for a rear-supply flush toilet. A support bracket 27, 127 supports the refill reservoir 21 and flush valve spud connection 20, 120. Like the flushing rim 44, the support bracket 27, 127 is supported on the housing 12 by the step 42. As seen in FIGS. 3, 4, 7, 8, 9A and 9B, rails 72 are fastened, using threaded bolts or other fasteners, to the rear portion of the shelves 42 on each half of the housing 12 and the support bracket 27, 127 is fastened to the rails 72 and the halves 13 of the housing 12 so as to be positioned between the two halves 13 of the housing 12. Constructed in this fashion, the toilet 10, 110 is readily configured for either a top-supply or a rear-supply flush valve spud connection 20, 120.

To aid in installation of the toilet 10, 110, a removeable top access cover 28, 128 is provided rearward of the seat 16. The access cover 28, 128 extends laterally between the halves 13 of the housing 12, resting on the upper surface 40 thereof, and is provided so as to be flush with the rear end of the seat 16 when mounted to the housing 12. The flush mounting further facilitates easy cleaning of the present toilet 10, 110. To facilitate positioning of the access cover 28, 128, as seen in FIG. 3, the cover 28, 128 has on it lower side, at its front end, an elongated transverse header 76 that is correspondingly shaped so as to enable its ends to be received on the shelf 42 of the halves 13 of the housing 12. The header 76 also functions to further strengthen and rigidify the cover 28, 128. At its rear end, the cover 28, 128 is shaped extend over the rails 72 and rest on the upper surface 40. When employed with a top-supply flush valve spud connection 20, the cover 28 further includes a cutout 78 that receives the flush connection or vertical stack 80 of the flush valve spud connection 20. When employed with a wall-supply flush valve spud connection 120, the cutout 74 is omitted from the access cover 128. The access cover 28, 128 may be secured to the housing 12 by fasteners 82 extending through the cover and into the housing. The fasteners 82 may be flush with the top of the access cover 28, 128 or recessed and covered with flush mounted caps.

Further when employed with a top-supply flush valve spud connection 20, the toilet 10 may include a valve cover 84, as seen in FIG. 1B and mentioned above. The valve cover 84 conceals the top-supply flush valve spud connection 20 and its associated water line exiting the wall. With the valve cover 84 installed, a toilet 10 having top-supply flush valve spud connection 20 can be rendered ligature resistant. Furthermore, the toilet 10 is provided with aesthetics similar to a conventional rear tank, gravity fed toilet, further avoiding an institutional look to the toilet.

Figure 10A:
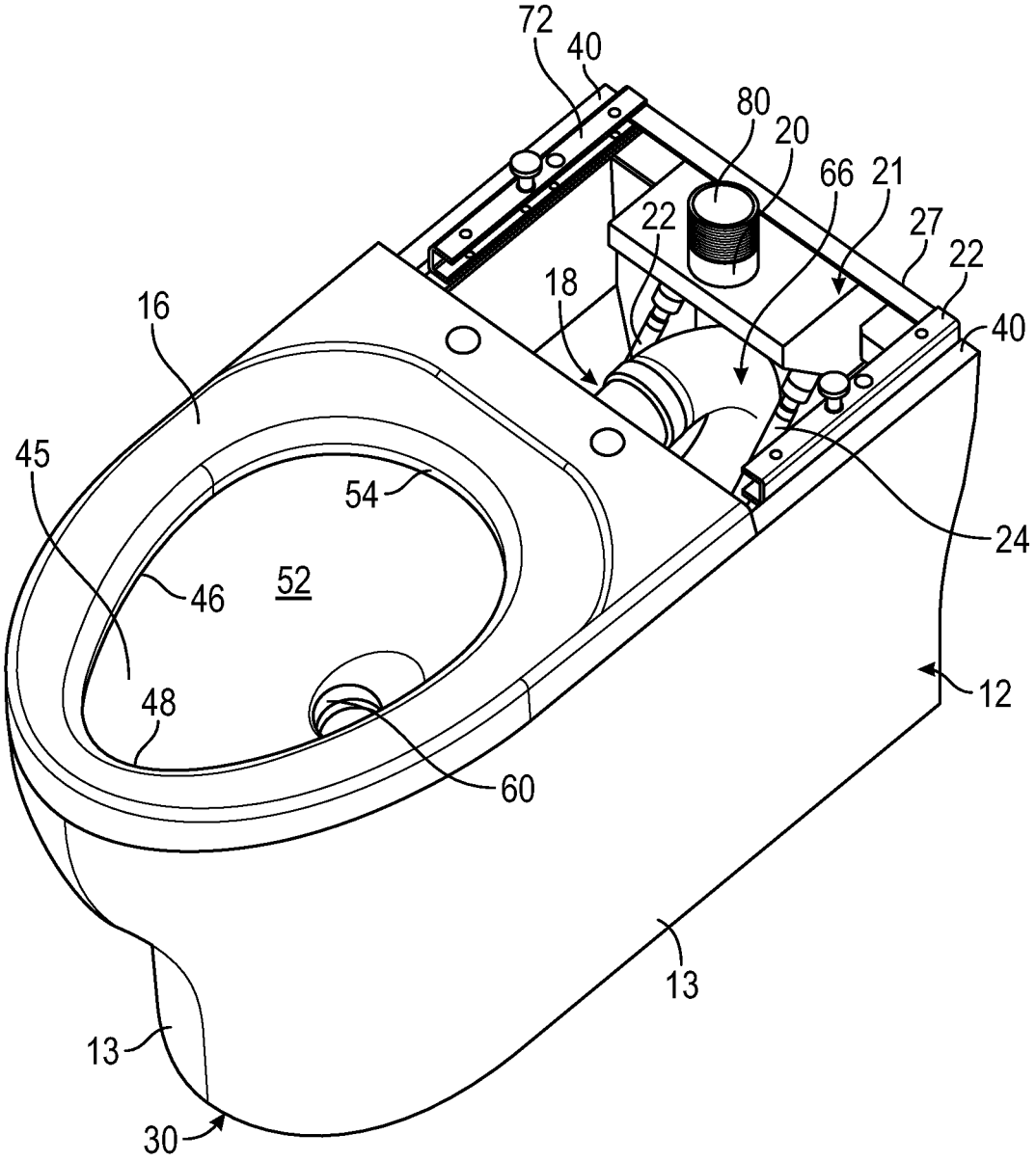
FIGS. 10A and 10B are perspective views of the toilet with the rear access cover removed.
Figure 10B:
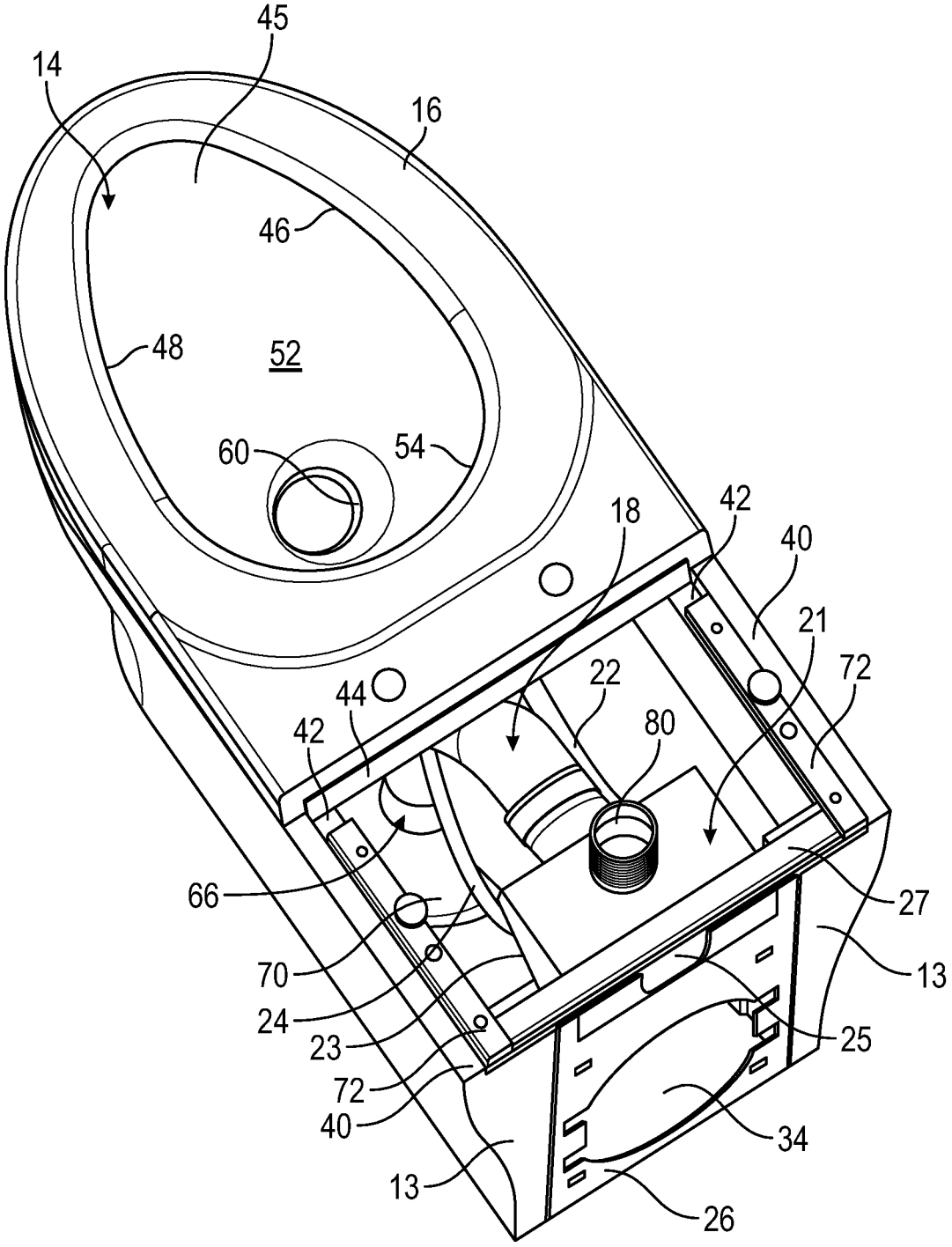

When the access cover 28, 128 is removed from the housing 12, as seen in FIGS. 10A and 10B, the resultant opening provides access to the gasket flange 70 and flange bolts used therewith in securing the toilet 10, 110 to the flange of the drain pipe (not shown). With the access cover 28, 128 removed, the flexible water supply lines 22, 24 are also readily accessible for removal from or connection to the spreader 50 and blow-out jet 58, if necessary.

The above description is meant to be illustrative of at least one preferred implementation incorporating the principles of the invention. One skilled in the art will readily appreciate that the invention is susceptible to modification, variation and change without departing from the true spirit and fair scope of the invention, as defined in the claims that follow. The terminology used herein is therefore intended to be understood in the nature of words of description and not words of limitation.

We claim:

1. A toilet for connecting a flush valve to a drain pipe of a waste drainage system, the toilet comprising:

a housing;

a bowl, the bowl enclosed by and support on the housing, the bowl including a waste receptacle defined between an upper opening and a waste outlet, portions of the bowl forming a rinse channel, the rinse channel being defined by an upwardly extending outboard wall and a floor extending inwardly from the outboard wall to the upper opening;

a seat fixedly coupled to the bowl and defining a seating surface with a central opening, the central opening of the seat being smaller than the upper opening; the seat including a portion extending over the floor and defining a top wall of the rinse channel and cooperating with the rinse channel to define a rinse slot extending about at least a portion of the upper opening; and a P-trap assembly, the P-trap assembly having an inlet positioned at and connected to the waste outlet of the bowl.

2. The toilet according to claim 1, wherein the rinse slot is open along at least a portion of its length.

3. The toilet according to claim 1, wherein the floor is downwardly sloped from the outboard wall to the upper opening.

4. The toilet according to claim 1, wherein the rinse slot decreases in width along opposing sides progressing from the rear of the bowl toward the front of the bowl.

5. The toilet according to claim 1, further comprising a raised land provided in the rinse channel and located toward a rear side of the bowl.

6. The toilet according to claim 5, wherein portions of the raised land define an upwardly extending inboard wall of the rise channel.

7. The toilet according to claim 6, wherein the inboard wall is generally opposed to a portion of the outboard wall.

8. The toilet according to claim 7, wherein the floor extends between the outboard wall and the inboard wall.

9. The toilet according to claim 5, wherein a portion of the raised land defines an upper surface, the upper surface being spaced below the top wall and a gap being defined therebetween.

10. The toilet according to claim 1, wherein the seat includes a lip extending downward from the top wall along at least a portion of the central opening of the seat, portions of the lip being located radially inward and spaced apart from the raised land so as to define a gap therebetween.

11. The toilet according to claim 1, further comprising a rinse water supply line, a refill reservoir and a flush valve spud connection, the flush valve spud connection configured for connection to the flush valve, the rinse water supply line including a nozzle terminating at and configured for directing rinse water into the rinse slot, the refill reservoir fluidly connecting the flush valve spud connection to the rinse water supply line, the refill reservoir including a plurality of walls defining a reservoir chamber within the refill reservoir, the reservoir chamber having a upper end and a lower end.

12. The toilet according to claim 11, wherein the rinse water supply line is coupled to the refill reservoir adjacent to the lower end of the reservoir chamber.

13. The toilet according to claim 11, further comprising a blow-out jet water supply line, the blow-out jet water supply line including a blow-out jet nozzle connected to the P-trap assembly, the refill reservoir fluidly connecting the flush valve spud connection to the blow-out jet water supply line.

14. The toilet according to claim 13, wherein the blow-out jet water supply line is coupled to the refill reservoir adjacent to the lower end of the reservoir chamber.

15. The toilet according to claim 13, wherein the refill reservoir is positioned at a height relative to the toilet that is greater than a height defined by one of a weir of P-trap assembly and the blow-out jet nozzle.

16. The toilet according to claim 13, wherein the housing, bowl and seat are constructed of a first material, and wherein the refill reservoir is constructed of a second material, the first material being a solid surface material, the second material being different than the first material.

17. The toilet according to claim 1, wherein the seat includes a downwardly extending lip extending downward from the top wall and located along at least a portion of the central opening of the seat, portions of the lip being located radially inward and spaced apart from the floor to define a gap therebetween.

18. A hybrid toilet for connecting a flush valve to the drain pipe of a waste drainage system, the toilet comprising:

a housing enclosing a bowl, the bowl including portions defining a receptacle defined between an upper opening and a waste outlet, a seat fixedly coupled to the bowl, the seat defining a seating surface above the bowl and having a central opening, the central opening being smaller than the upper opening of the bowl;

the housing, bowl and seat being formed of a first material, the first material being a solid surface material; and a P-trap assembly, the P-trap assembly having an inlet positioned at and connected to the waste outlet of the bowl, the P-trap assembly being constructed of a second material, the second material being different than the first material.

19. The hybrid toilet according to claim 18, wherein the second material is stainless steel.

20. The hybrid toilet according to claim 18, wherein the P-trap assembly includes a U-bend and a trap arm, the U-bend having a first section extending downward from waste outlet and a second section extending upward from the first section, and the trap arm defining a weir of the P-trap assembly.

21. The hybrid toilet according to claim 20, wherein the second section extends upward to a position above the waste outlet.

22. The hybrid toilet according to claim 18, wherein the seat is fixed and immoveable relative to the housing.

23. The hybrid toilet according to claim 18, further comprising a transition area between the seat and housing, the transition area being a smooth transition surface.

24. The hybrid toilet according to claim 18, wherein the P-trap assembly is removably connected to the waste outlet of the bowl and adapted for replacement by a second P-trap assembly having a different rough-in configuration.

25. The hybrid toilet according to claim 18, wherein the P-trap assembly is removably connected to the waste outlet of the bowl.

26. The hybrid toilet according to claim 18, wherein the P-trap assembly is removably connected to the waste outlet of the bowl by threaded fasteners in engagement with the bowl.

* * * * *